US010468741B2

(12) United States Patent
Day

(10) Patent No.: US 10,468,741 B2
(45) Date of Patent: Nov. 5, 2019

(54) PHASED ARRAY ANTENNA ASSEMBLY

(71) Applicant: Elta Systems Ltd., Ashdod (IL)

(72) Inventor: Arie Day, Moshav Shtulim (IL)

(73) Assignee: Elta Systems Ltd., Ashdod (IL)

( * ) Notice: Subject to any disclaimer, the term of this patent is extended or adjusted under 35 U.S.C. 154(b) by 540 days.

(21) Appl. No.: 14/917,695

(22) PCT Filed: Sep. 15, 2014

(86) PCT No.: PCT/IL2014/050820

§ 371 (c)(1),
(2) Date: Mar. 9, 2016

(87) PCT Pub. No.: WO2015/037007

PCT Pub. Date: Mar. 19, 2015

(65) Prior Publication Data

US 2016/0218412 A1 Jul. 28, 2016

(30) Foreign Application Priority Data

Sep. 15, 2013 (IL) ..... 228426

(51) Int. Cl.
*H01Q 1/02* (2006.01)
*H01Q 21/00* (2006.01)

(52) U.S. Cl.
CPC ..... *H01Q 1/02* (2013.01); *H01Q 21/00* (2013.01); *H01Q 21/0025* (2013.01); *H01Q 21/0087* (2013.01)

(58) Field of Classification Search
CPC .. H01Q 21/0087; H01Q 21/0025; H01Q 1/02; H01Q 21/00
See application file for complete search history.

(56) References Cited

U.S. PATENT DOCUMENTS

| | | | | |
|---|---|---|---|---|
| 6,184,832 | B1 | 2/2001 | Geyh et al. | |
| 6,297,775 | B1 | 10/2001 | Haws et al. | |
| 7,110,260 | B2 | 9/2006 | Weber et al. | |
| 2003/0218566 | A1 | 11/2003 | Feldle et al. | |
| 2005/0270250 | A1 | 12/2005 | Edward et al. | |
| 2007/0035448 | A1* | 2/2007 | Navarro | H01Q 1/02 343/700 MS |
| 2011/0279343 | A1* | 11/2011 | Giovannelli | H01Q 1/02 343/850 |

(Continued)

FOREIGN PATENT DOCUMENTS

| | | | |
|---|---|---|---|
| JP | 3618858 | B2 | 2/2005 |
| JP | 2011-244266 | A | 12/2011 |

(Continued)

*Primary Examiner* — Hai V Tran
(74) *Attorney, Agent, or Firm* — Mintz Levin Cohn Ferris Glovsky and Popeo, P.C.; Steven M. Jensen

(57) ABSTRACT

A carrier plate configured for mounting thereto of a plurality of communication units to form a phased array antenna; The carrier plate is integrally formed with a plurality of sockets, each of the sockets being adapted to receive therein at least one of the plurality of communication unit; The carrier plate is further integrally formed with one or more cooling channels extending along the carrier plate and associated with the sockets; The channels are configured for passage of a cooling fluid therethrough for cooling of the plurality of units during operation of the antenna.

17 Claims, 7 Drawing Sheets

(56) References Cited

U.S. PATENT DOCUMENTS

| | | | |
|---|---|---|---|
| 2012/0063098 | A1 | 3/2012 | Paquette et al. |
| 2012/0068906 | A1 | 3/2012 | Asher et al. |
| 2012/0162922 | A1 | 6/2012 | Cheyne et al. |

FOREIGN PATENT DOCUMENTS

| | | | |
|---|---|---|---|
| WO | 01/08285 | A1 | 2/2001 |
| WO | 02/23966 | A2 | 3/2002 |

* cited by examiner

PHASED ARRAY ANTENNA ASSEMBLY

TECHNOLOGICAL FIELD

This invention relates to phased array antennas, in particular, to cooling and temperature control mechanisms therefore.

BACKGROUND

A phased array antenna generally comprises a plurality of individual modules, each having a transmit/receive circuitry. The modules are arranged in an array, usually by mounting each module onto a carrier assembly.

When mounted onto the carrier assembly, each module is adapted to be connected to additional transmit/receive circuitry so that it may be attached to a mainframe or a control center.

Electrical work of the modules usually generates heat, which has a negative effect on the electrical performance of power amplifiers comprised within the modules. Therefore, it is required to cool the modules down in order to increase performance of the modules and prevent malfunction thereof.

In cooling the modules, not only the overall temperature of a single module has an effect on performance, but also the temperature variation between different modules of the same array. Thus, it is also required to maintain a low temperature variation between modules, i.e. maintain a sufficiently uniform temperature across the entire phased array antenna, allowing it to operate properly.

Cooling of the modules, as any other cooling, may be performed by one or more of the three known mechanisms: radiation, convection and conduction. Common methods for cooling the modules includes a system of cooling pipes adapted for the flow of a cooling fluent therein, thereby removing heat from the modules by convection. Also, it is known to attach to the carrier assembly a radiation plate, thereby further removing heat from the modules by radiation.

GENERAL DESCRIPTION

According to one aspect of the disclosed subject matter of the present application, there is provided a carrier plate configured for mounting thereto a plurality of communication units to form a phased array antenna, said carrier plate being integrally formed with a plurality of sockets, each of said sockets being adapted to receive therein one of said plurality of communication units, wherein said carrier plate is further integrally formed with one or more cooling channels extending along said carrier plate and associated with said sockets, and configured for passage of a cooling fluid therethrough for cooling of said plurality of communication units during operation of said antenna.

Under the above arrangement, the carrier plate constitutes, within a single block of material, all of the following:

- the antenna body constituted by the sockets configured for receiving the communication unit);
- the cooling arrangement constituted by the cooling channels; and
- the supporting structure of the antenna itself.

In connection with the above, it is appreciated that this arrangement provides for a considerably simpler and more efficient design, elegantly eliminating the need for a separate cooling arrangement and/or a support structure, as common in the field.

The carrier plate can be configured for mounting thereto, on an opposite side of the sockets, a transmission module configured for connecting to the individual communication units and provide and/or receive signals therefrom. It should be noted that, despite the terms 'transmission' and 'communication', such an antenna can operate at either a transmission only mode, receiving only mode or a combination of both.

In this connection, since the cooling arrangement is integrated in the structure of the carrier plate itself (and not individually provided to each transmission module), this configuration allows for a simple plug-in of the transmission modules. Specifically, in order to mount/dismount such a transmission module onto/from the carrier plate, it is not required to attach/detach any cooling pipes or conduits. The transmission module can simply be mounted onto the carrier plate and plug into the leads of the communication units.

The arrangement can be such that when said communication units are placed within said sockets, they are in surface-to-surface contact with the carrier plate, so that there is provided heat conduction between said communication units via said carrier plate. In particular, the carrier plate can have a cooling surface configured, when the communication units are placed, to be interposed between the cooling channel and the communication unit.

One of the advantages of the above design lies in the compact configuration of the antenna which, inter alia, reduced the physical distance between the communication units and the transmission module, thereby reducing losses and making the system more efficient.

In addition, since the carrier plate is made of a single, solid material, it provides the antenna with toughness and stability which are considerably high with respect to its weight, thereby reducing system errors which may be caused by deformation in the array of the communication modules.

According to a specific design, the carrier plate can be constituted by a plurality of modular carrier plate units, each being integrally formed with its own socket/s and cooling channel/s, the units being configured for successive attachment to one another to form a combined antenna of greater dimensions.

In particular, the arrangement can be such that, when two or more carrier plates are attached to one another along one direction, the cooling channels thereof are collinear and become interconnected, allowing fluid communication therebetween. When the carrier plates are attached to one another along a second direction, different than the first, the cooling channels can be arranged parallel/angled to one another.

Per the above, when a plurality of modular units are connected to one another in any way, a distribution arrangement can be provided for interconnecting the cooling channels of each of the modular carrier plate units to provide fluid association between the channels.

When two or more carrier plates are attached to one another not along the longitudinal direction (e.g. so that the cooling channels thereof are parallel to one another), at least two configuration of the fluid distribution arrangement can be provided:

Parallel cooling—the distribution arrangement comprises a main feed with a manifold simultaneously connected to first, inlet ends of the cooling channels and a main outlet with a manifold simultaneously connected to second, outlet ends of the cooling channels so that each of the cooling channels simultaneously receives, in parallel, a cooling fluid. Thus, at all the first ends (inlet) the cooling fluid is of the lowest temperature and at all the second ends (outlet), the cooling fluid is of the highest temperature (having removed heat from the communication units).

In-line cooling the cooling channels are connected in a consecutive manner, the second end (outlet) of one channel being connected to the first end (inlet) of the cooling channel of the consecutive carrier plate. Thus, the cooling fluid enters the first end of the first cooling channel at the lowest temperature and is emitted from the second end of the last cooling channel at the highest temperature.

However, according to a specific design of the subject matter of the present application, each carrier plate can be formed with a first cooling channel and a second cooling channel. The distribution arrangement can be configured for a unique successive connection of the cooling channels so that fluid is first forced to flow through the first channel of each of the carrier plates and only then returned through the second channel of each of the carrier plates.

With regards to the above, the cooling fluid enters the first channel of the first carrier plate at the lowest temperature t and reaches the outlet end of the first channel of the last carrier plate at a higher temperature t'>t. Thereafter, it is returned first through the second channel of the last carrier plate and, after passing through the second cooling channels of all carrier plate units, reaches the outlet end of the second channel of the first carrier plate unit at a temperature T>t'>t.

The unique arrangement above provides that the average temperature of the cooling fluid in each carrier plate is approx. t'. This arrangement allows, on the one hand, the simplicity of a successive connection between carrier plates (not requiring a manifold and not limited in size) and, on the other hand, for a uniform average temperature between all carrier plates.

The carrier plate can further be formed with a utility channel configured for accommodating therein all the necessary electronic/mechanical components required for the operation of the communication units. The arrangement can be such that the utility channel is isolated from the one or more cooling channels. In particular, in case the carrier plate is made by extrusion, the material of the carrier plate itself forms the barrier between the one or more cooling channels and the utility channel, providing said isolation.

In addition, according to one example, the modular units may be made of the same material, facilitating uniform heat conduction throughout the carrier plate. Alternatively, according to another example, each of the modular units may be made of a different material, depending on the communication unit adapted to be received in the socket thereof.

According to another aspect of the subject matter of the present application, there is provided a method for configuring a cooling arrangement of a phased array antenna comprising two or more carrier plates of the previous aspect of the present application, each carrier plate having a first cooling channel and a second cooling channel, the method includes the steps of:

a) providing a fluid inlet associated with a first end of the first channel of the first carrier plate;
b) consecutively attaching a second end of the first channel of each carrier plate but last to the first end of the first channel of a successive carrier plate;
c) attaching the second end of the first channel of the last carrier plate with a first end of the second channel of the last carrier plate;
d) consecutively attaching a second end of the second channel of each carrier plate but first to the first end of the first channel of a successive carrier plate; and
providing a fluid outlet associated with a second end of the second cooling channel of the first carrier plate.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1A:
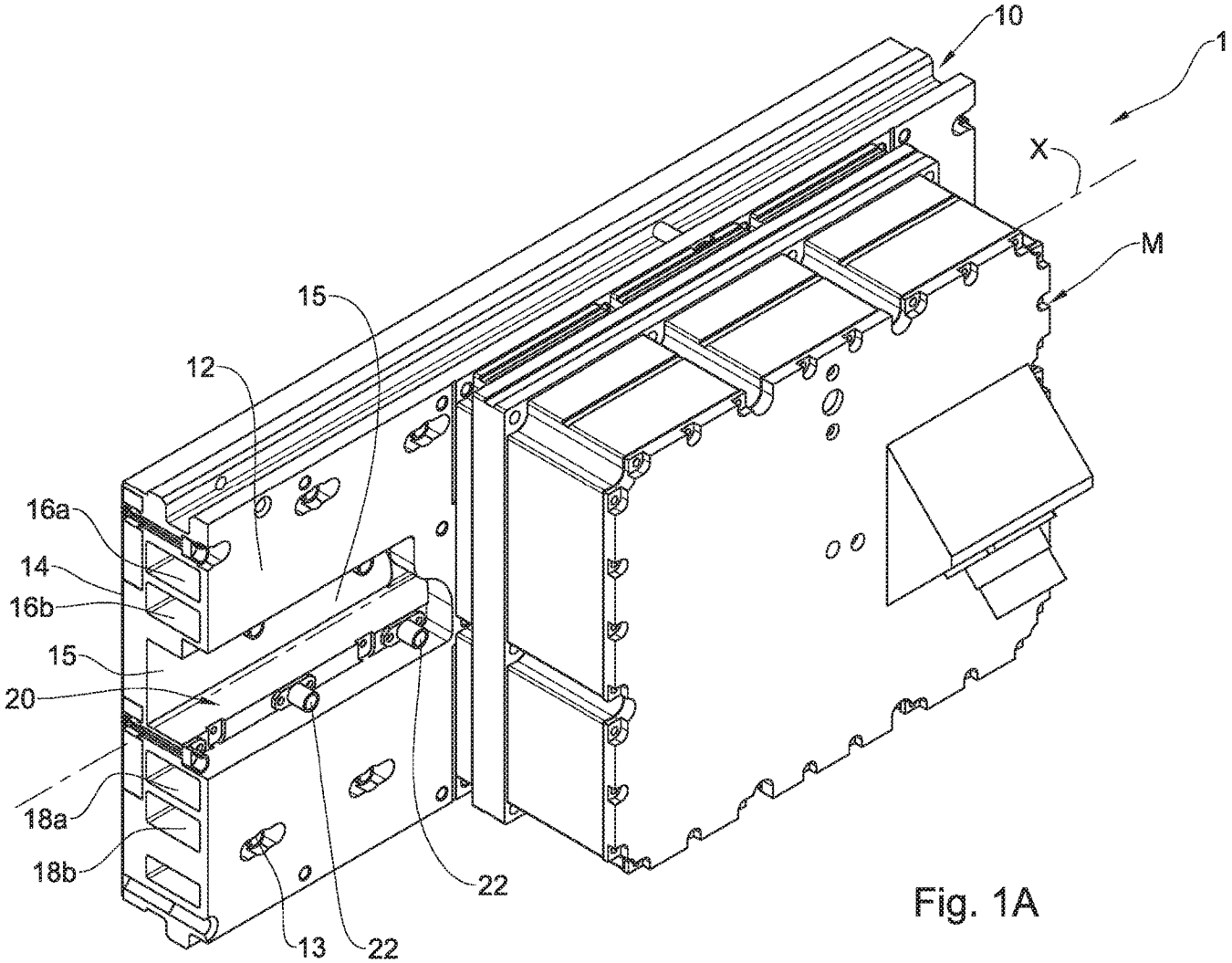
FIG. 1A is a schematic rear isometric view of a portion of a carrier plate of the present application with a plurality of communication units attached thereto.
Figure 1B:
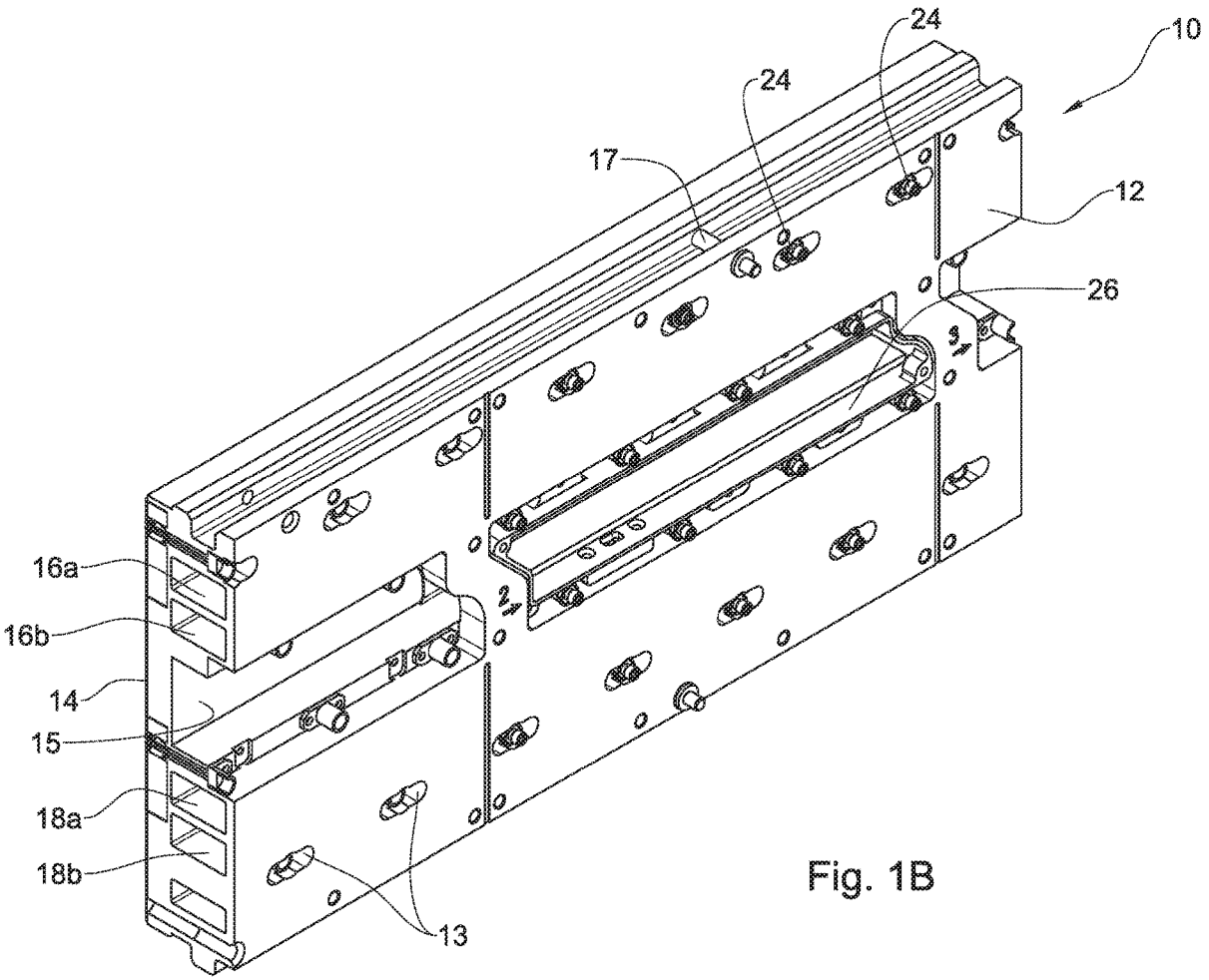
FIG. 1B is a schematic rear isometric view of the carrier plate shown in FIG. 1A.

Attention is first drawn to FIGS. 1A to 1E in which a part of a phased array antenna is shown generally designated 1 and comprising a carrier plate 10 and a transmission module M mounted thereon. The phased array antenna 1 is further provided with a front cover P, configured for shielding.

The carrier plate 10 is made of a single extruded body having a rear surface 12 and a front surface 14, the plate 10 having a longitudinal axis X defining a first direction of the plate 10 (parallel to the direction of extrusion).

Figure 1C:
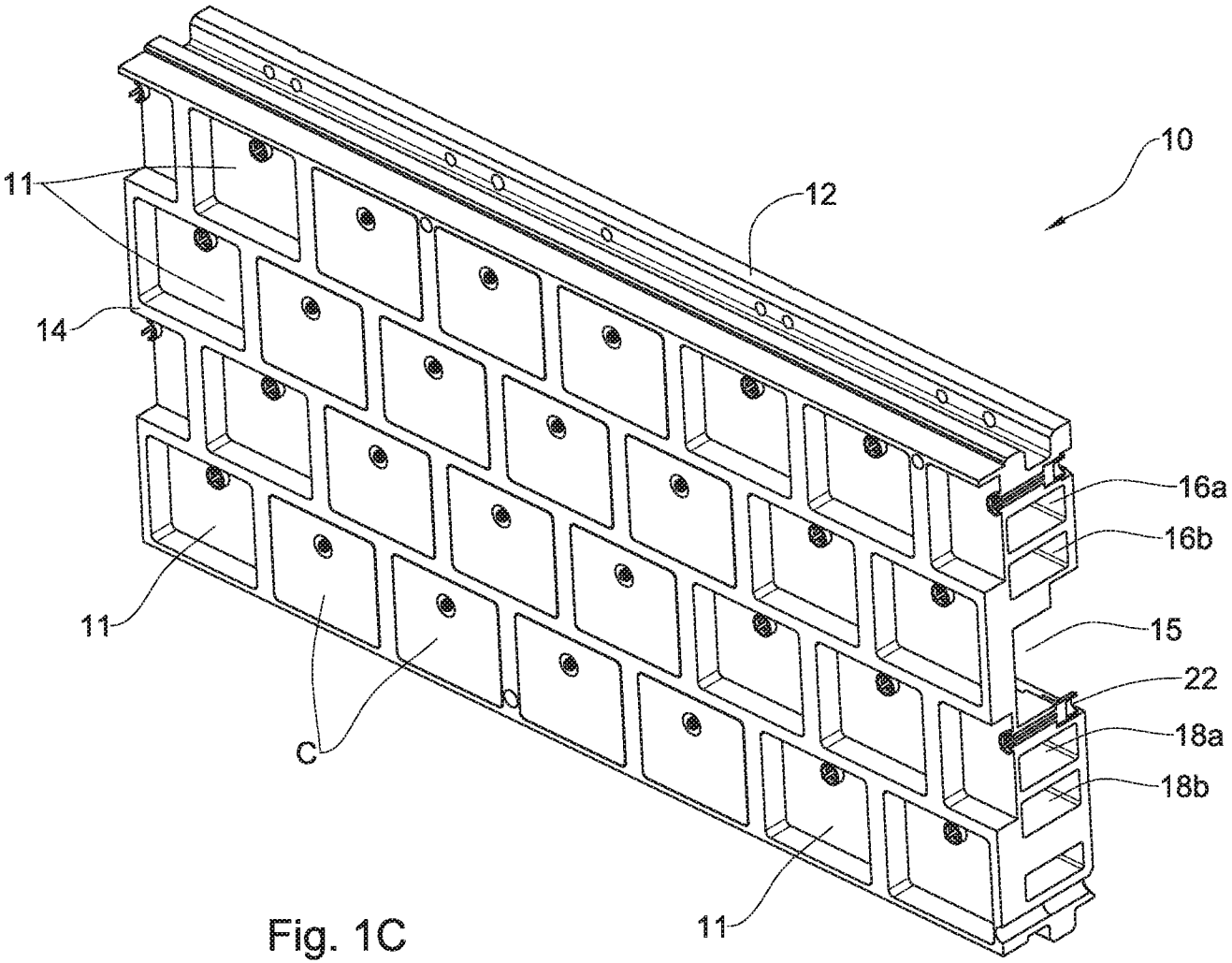
FIG. 1C is a schematic front isometric view of the carrier plate shown in FIG. 1A.
Figure 1D:
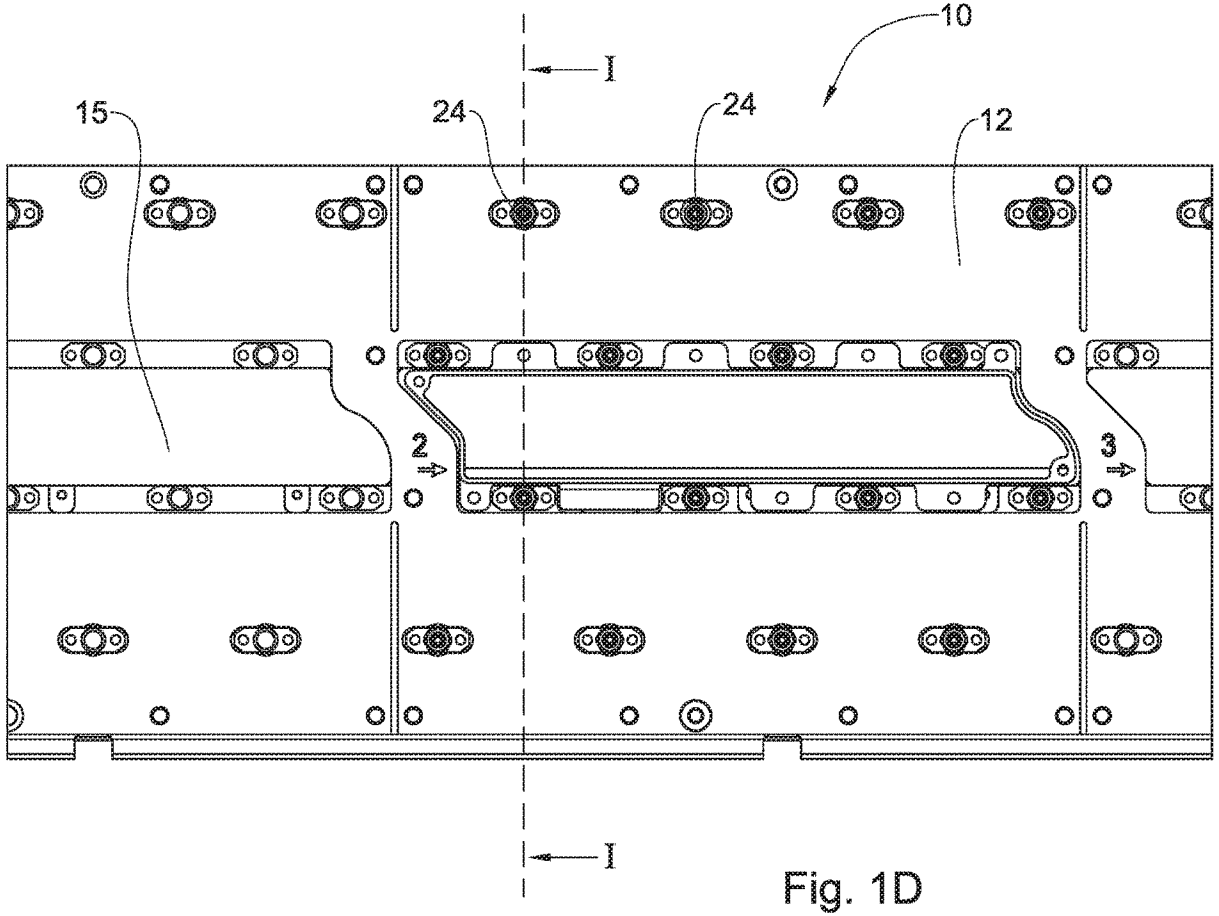
FIG. 1D is a schematic rear view of the carrier plate shown in FIG. 1B.
Figure 1E:
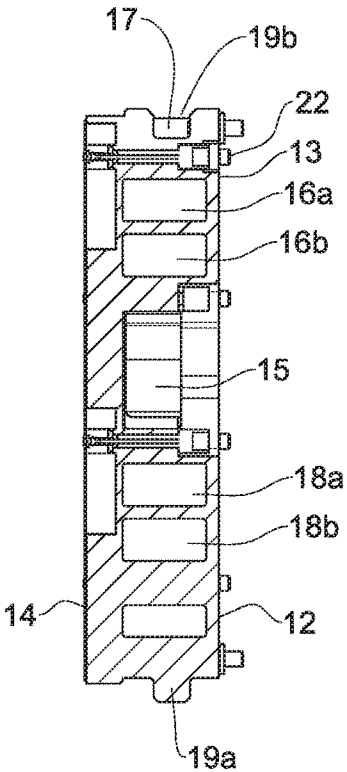
FIG. 1E is a schematic cross section of the carrier plate shown in FIG. 1B.

With particular reference being made to FIG. 1C, the front surface 14 of the carrier plate 10 is formed with a plurality of sockets 11 configured for accommodating therein a corresponding plurality of communication units C, which are in turn associated with the transmission module M, mounted on the rear surface 12 of the carrier plate 10. The communication units C are shielded by the cover plate P (shown FIGS. 2A, 2B).

In the course of operation of the phased array antenna 1, the module M and communication units C generate a considerable amount of heat which is required to be removed from the antenna.

For this purpose, the carrier plate 10 is formed with a first set of cooling channels 16*a*, 16*b* and a second set of cooling channels 18*a*, 18*b*, each extending along the longitudinal axis X and being formed during the extrusion process. The cooling channels 16*a*, 16*b*, 18*a*, 18*b* are configured for the passage therethrough of a cooling fluid for cooling the module M mounted onto the carrier plate 10, and are each provided with openings at respective ends of the carrier plate 10, configured for serving as fluid inlets or fluid outlets.

The arrangement is such that the first set of cooling channels 16*a*, 16*b* is located at a top portion of the carrier plate 10 while the second set of cooling channels 18*a*, 18*b* is located at a bottom portion of the carrier plate 10.

Between the top portion and the bottom portion there extends a utility channel 15, configured for accommodating therein the electronic wiring and utility components required for operation of the antenna. The utility channel 15 is machined out of the solid piece of the carrier plate 10 and is completely isolated from the cooling channels 16*a*, 16*b*, 18*a*, 18*b*, so that the above electronic components are protected from coming in contact with any cooling fluid flowing within the channels.

Figure 2A:
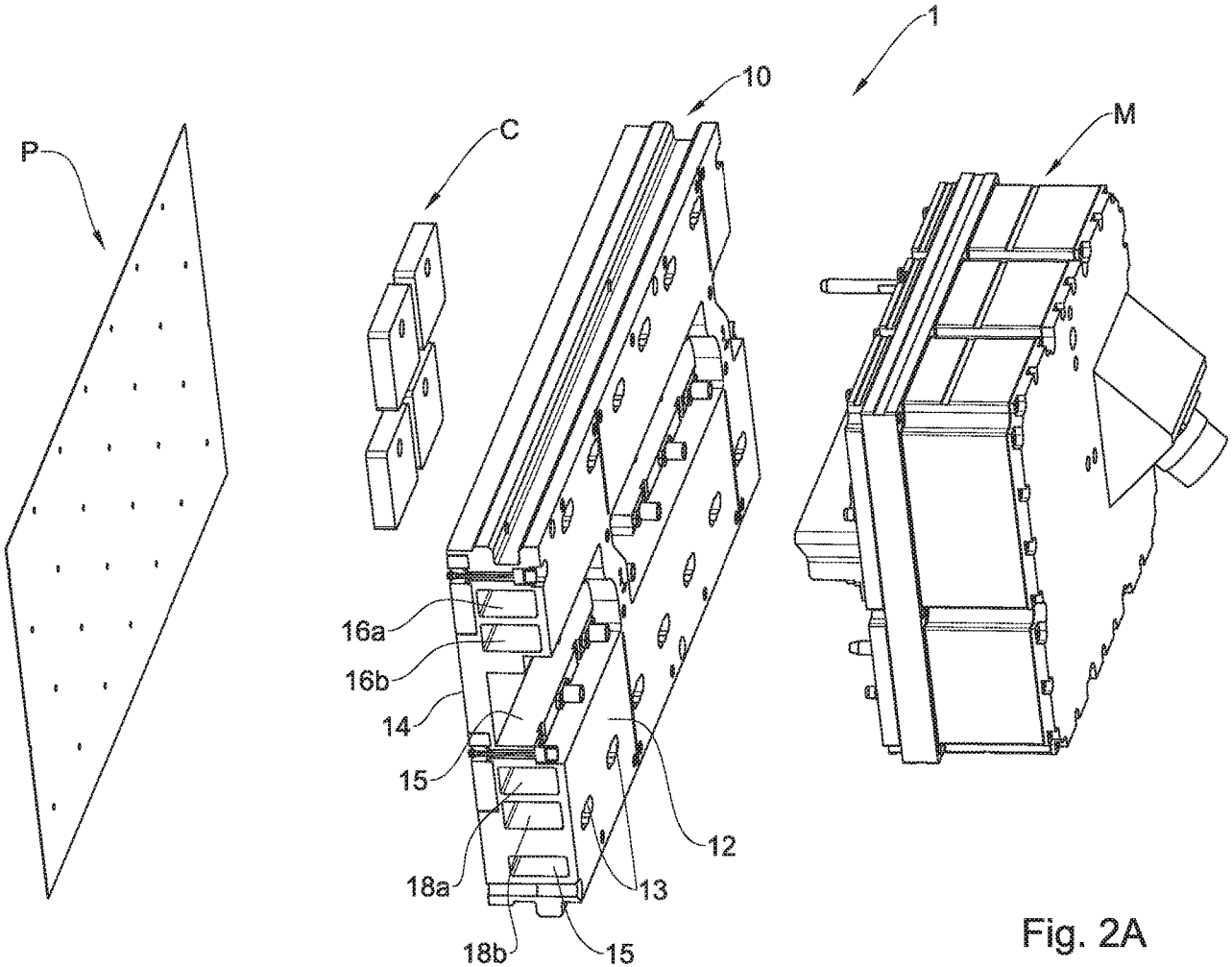
FIG. 2A is a rear exploded view of the carrier plate shown in FIG. 1A.
Figure 2B:
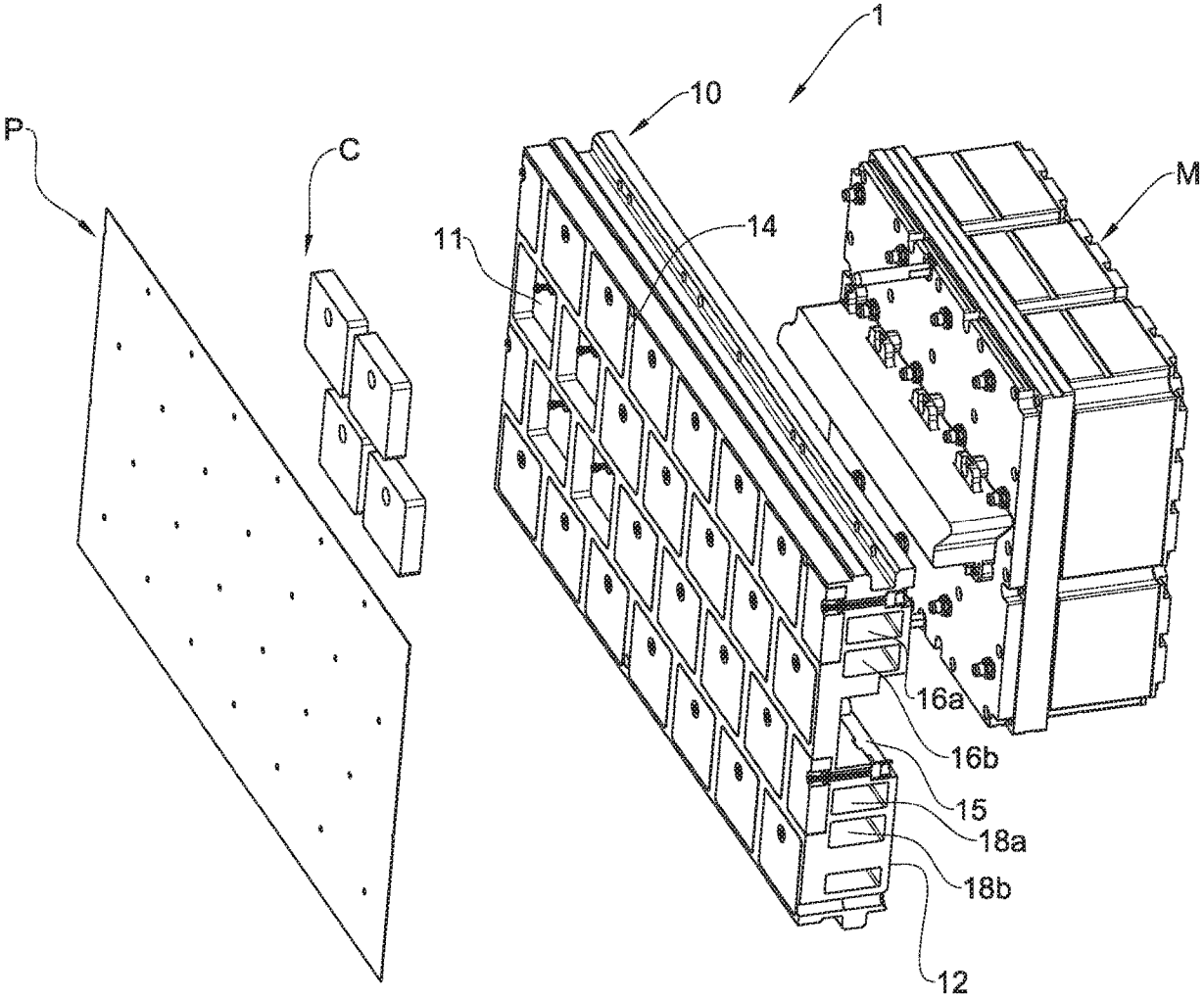
FIG. 2B is a front exploded view of the carrier plate shown in FIG. 1A.
Figure 3:
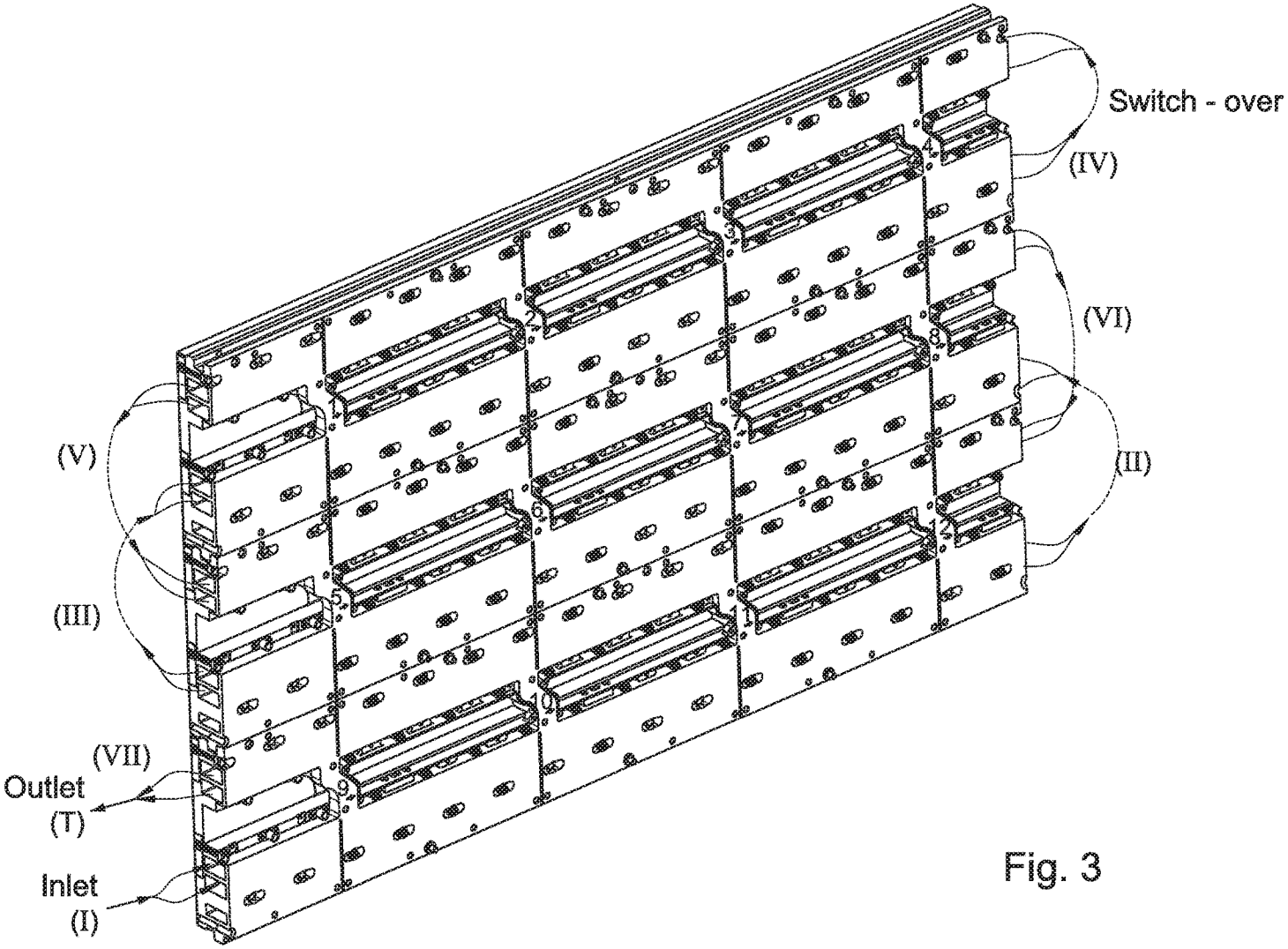
FIG. 3 is a schematic isometric view of a carrier plate formation constituted by a plurality of carrier plates shown in FIG. 1B.

With additional reference being made to FIGS. 2A and 2B, the carrier plate 10 is configured for attachment to additional carrier plates 10 along a lateral direction, perpendicular to the longitudinal direction, in order to form a multi-plate (see FIG. 3). For this purpose, each carrier plate 10 is formed, at the bottom portion thereof with a longitudinal protrusion 19*a* and at a top portion thereof with a longitudinal groove 19*b*. In order to secure carrier plates 10 to each other, securing pins 17 are used, extending between the front surface 14 and the rear surface 12, passing through the protrusion 19*a*.

It is appreciated that since each carrier plate 10 is manufactured by extrusion, and since carrier plates 10 can be attached to each other successively along the above lateral direction, it is possible to construct, using carrier plates 10 of various lengths, almost any desired shape of the multi-plate for the multi-phase antenna.

The carrier plate 10 is also formed with openings 13, extending between the front surface 14 and the rear surface 12, each being configured for accommodating therethrough a guide port 22. Each of these guide ports 22, in turn, is configured for receiving therein a plug 24 connecting the communication units C with the transmission module M.

Turning now to FIG. 3, the cooling method of the modules M and the carrier plates 10 will now be described, and includes the following steps:

cooling fluid at temperature $T_0$ is provided through the inlet I of the second set of cooling channels 18*a*, 18*b* of the first carrier plate;

the cooling fluid is then passed through the first carrier plate (sections 9, 10, 11 and 12 of the multi-plate, consecutively) being gradually heated as it absorbs heat (by convection) from the modules M and communication units C;

the cooling fluid is then emitted from the outlet II of the second set of cooling channels 18*a*, 18*b* at the opposite end of the first carrier plate 10 at temperature $T_1>T_0$;

the cooling fluid is then passed into the second set of cooling channels 18*a*, 18*b* of the second carrier plate 10 (the plate immediately above it);

the cooling fluid flows through the second carrier plate (sections 8, 7, 6 and 5 consecutively) being further heated;

the cooling fluid is emitted from the outlet III of the second carrier plate at a temperature $T_2>T_1>T_0$;

the cooling fluid is then passed into the second set of cooling channels 18*a*, 18*b* of the third carrier plate 10;

the cooling fluid flows through the third carrier plate (sections 1, 2, 3 and 4 consecutively) being further heated;

the cooling fluid is emitted from the outlet IV of the third carrier plate at a temperature $T_3>T_2>T_1>T_0$.

the cooling fluid is then passed into the first set of cooling channels 16*a*, 16*b* of the third carrier plate 10 (i.e. the same carrier plate as opposed to the previous 2);

the cooling fluid flows through the third carrier plate again, but in the opposite direction (sections 4, 3, 2 and 1 consecutively) being further heated;

the cooling fluid is then emitted from the outlet V of the third carrier plate at a temperature $T_4>T_3>T_2>T_1>T_0$;

the cooling fluid is then passed into the first set of cooling channels 16*a*, 16*b* of the second carrier plate 10;

the cooling fluid flows through the second carrier plate (sections 5, 6, 7 and 8 consecutively) being further heated;

the cooling fluid is emitted from the outlet VI of the second carrier plate at a temperature $T_5>T_4>T_3>T_2>T_1>T_0$;

the cooling fluid is then passed into the first set of cooling channels 16*a*, 16*b* of the first carrier plate 10;

the cooling fluid flows through the first carrier plate (sections 12, 11, 10 and 9 consecutively) being further heated;

the cooling fluid is emitted from the first carrier plate at a temperature $T_6>T_5>T_4>T_3>T_2>T_1>T_0$;

With reference to the above, it is observed that the average temperature of the cooling fluid in each carrier plate is essentially the same:

First carrier plate:
Second set of cooling channels—$(T_0+T_1)/2$;
First set of cooling channels—$(T_5+T_6)/2$;
Overall temperature—$(T_0+T_1+T_5+T_6)/2$
Second carrier plate:
Second set of cooling channels—$(T_1+T_2)/2$;
First set of cooling channels—$(T_4+T_5)/2$;
Overall temperature—$(T_1+T_2+T_4+T_5)/2$
Third carrier plate:
Second set of cooling channels—$(T_2+T_3)/2$;
First set of cooling channels—$(T_3+T_4)/2$;
Overall temperature—$(T_2+T_3+T_3+T_4)/2$ This method of passage of the cooling fluid through the carrier plates elegantly provides for averaging of the temperature in each carrier plate. Furthermore, it also makes sure that the temperature at one end of the carrier plate is not considerably greater/lower than the temperature at the other end of the same carrier plate (as would be the case if cooling fluid was passed in parallel simultaneously through all carrier plates). In particular, $(T_0+T_6)/2$ (at the inlet end of carrier plate 10) is essentially equal to $(T_1+T_5)/2$ (at the opposite end of the carrier plate 10).

Those skilled in the art to which this invention pertains will readily appreciate that numerous changes, variations, and modifications can be made without departing from the scope of the invention, mutatis mutandis.

The invention claimed is:

1. A carrier plate assembly configured to receive a plurality of communication units to form a phased array antenna, said carrier plate assembly comprising at least two carrier plates, each of the carrier plates being integrally formed with a plurality of sockets, each of said sockets being adapted to receive therein at least one of said plurality of communication units, wherein each of the carrier plates is further integrally formed with at least respective first and second cooling channels extending along each of the carrier plates in a first direction and associated with said sockets, each of the carrier plates further allowing a passage of a cooling fluid through said first and second cooling channels in order to cool said plurality of communication units during operation of said antenna, wherein the carrier plates are attached to one another along a second direction, different than the first direction, such that the respective cooling channels of the carrier plates are parallel or angled with respect to one another, and wherein the carrier plate assembly further comprises a distribution arrangement interconnecting the first and second cooling channels and to provide the cooling fluid association therebetween, the distribution arrangement connecting the first and second cooling channels of all of the carrier plates in series such that the cooling fluid flows successively through all of the first cooling channel before flowing successively through all of the second cooling channel.

2. The carrier plate assembly according to claim 1, wherein, said communication units, when placed within said sockets, are in surface-to-surface contact with the carrier plate, so that there is provided heat conduction between said communication units via said carrier plate.

3. The carrier plate assembly according to claim 1, wherein the carrier plate has a cooling surface configured, when the communication units are placed, to be interposed between the cooling channel and the communication unit.

4. The carrier plate assembly according to claim 1, wherein the carrier plate is constituted by a plurality of modular carrier plate units, each being integrally formed with its own cooling channel.

5. The carrier plate assembly according to claim 4, wherein the communication units are configured for successive attachment to one another to form an antenna of greater dimensions.

6. The carrier plate assembly according to claim 1, wherein, when the carrier plates are attached to one another along the first direction, the cooling channels thereof are collinear and become interconnected, allowing fluid communication therebetween.

7. The carrier plate assembly according to claim 1, wherein said distribution arrangement comprises a main feed with a manifold simultaneously connected to first ends of the cooling channels and a main outlet with a manifold simultaneously connected to second ends of the cooling channels so that each of the cooling channels simultaneously receives, in parallel, the cooling fluid.

8. The carrier plate assembly according to claim 1, wherein the cooling channels are connected in a consecutive manner, the second end (outlet) of one channel being connected to the first end (inlet) of the cooling channel of the consecutive carrier plate.

9. The carrier plate assembly according to claim 1, wherein the carrier plate is further formed with a utility channel configured for accommodating therein all the necessary electronic/mechanical components required for operation of the communication units.

10. The carrier plate assembly according to claim 9, wherein the utility channel is isolated from the first and second cooling channels.

11. The carrier plate assembly according to claim 10, wherein a material of the carrier plate forms the barrier between the first and second cooling channels and the utility channel.

12. The carrier plate assembly according to claim 1, wherein the at least two carrier plates are made of the same material, facilitating uniform heat conduction throughout the carrier plates.

13. The carrier plate assembly according to claim 1, wherein each of the at least two carrier plates is made of a different material, depending on the communication units adapted to be received in the sockets of each of the carrier plates.

14. A phased array antenna comprising two or more communication units mounted on the carrier plate assembly according to claim 1.

15. A method for configuring a cooling arrangement of a phased array antenna comprising at least two carrier plates, each carrier plate having a first cooling channel and a second cooling channel, the carrier plates being arranged so that the cooling channels thereof are not collinear, the method comprising the steps of:

a) providing a fluid inlet associated with a first end of the first cooling channel of a first carrier plate of the at least two carrier plates;

b) consecutively attaching a second end of the first cooling channel of each carrier plate, except a last carrier plate of the at least two carrier plates, to the first end of the first cooling channel of a successive carrier plate of the at least two carrier plates;

c) attaching the second end of the first cooling channel of the last carrier plate with a first end of the second cooling channel of the last carrier plate;

d) consecutively attaching a second end of the second cooling channel of each carrier plate, except the last carrier plate, to the first end of the first channel of the successive carrier plate; and e) providing a fluid outlet associated with the second end of the second cooling channel of the first carrier plate.

16. The method according to claim 15, wherein the cooling fluid enters the first cooling channel of the first carrier plate at a lowest temperature t and reaches an outlet end of the first cooling channel of the last carrier plate at a higher temperature $t'>t$, and thereafter returned first through the second cooling channel of the last carrier plate and reaches an outlet end of the second cooling channel of the first carrier plate at a temperature $T>t'>t$.

17. The method according to claim 16, wherein the average temperature of the cooling fluid in each carrier plate is approximately $t'$.

* * * * *